United States Patent [19]

Robillard

[11] 4,217,995

[45] Aug. 19, 1980

[54] CAULKING TUBE WITH AN IMPROVED SEAL TO RETARD THE PASSAGE OF AIR

[75] Inventor: Robert J. Robillard, Troy, N.Y.

[73] Assignee: General Electric Company, Waterford, N.Y.

[21] Appl. No.: 882,301

[22] Filed: Feb. 28, 1978

Related U.S. Application Data

[63] Continuation of Ser. No. 619,578, Oct. 6, 1975, abandoned.

[51] Int. Cl.[3] ..... B65D 83/00

[52] U.S. Cl. ..... 222/327

[58] Field of Search ..... 222/326, 327, 386; 206/384, 817; 252/59; 220/93

[56] References Cited

U.S. PATENT DOCUMENTS

| | | | |
|---|---|---|---|
| 2,343,026 | 2/1944 | Radbruch | 222/386 |
| 2,478,078 | 8/1949 | Battenfeld | 222/327 |
| 2,827,395 | 3/1958 | Jordan et al. | 252/59 X |
| 2,833,451 | 5/1958 | Sherbondy | 222/327 |
| 3,080,330 | 3/1963 | Rudel et al. | 252/59 X |
| 3,205,206 | 9/1965 | Marcantonio | 252/59 X |
| 3,250,443 | 5/1966 | Abbott | 222/327 |
| 3,428,565 | 2/1969 | Fischer | 252/59 |
| 3,503,542 | 3/1970 | Ungerer | 222/327 X |
| 3,527,389 | 9/1970 | Farmer | 222/327 |
| 3,815,791 | 6/1974 | Clark | 222/326 |

*Primary Examiner*—F. J. Bartuska

*Attorney, Agent, or Firm*—E. Philip Koltos; Joseph B. Forman

[57] ABSTRACT

The present invention relates to an improved caulking tube with a superior seal between the plunger and the rear of the caulking tube which is produced by coating the inside of the rear end of the body of the caulking tube with a moisture proof cohesive chemical material such that after the caulking tube is filled with the desired material and after the plunger is inserted there is produced an airtight moisture proof seal.

7 Claims, 5 Drawing Figures

12
17
17b
17c
18
19
21
17a
25
27
10
14
11
13
15
16

20
24
23
28
20a
22
21
26
10

29
31
42
21
26
43
27

32
33
37
21
36
34
35
10

38
39
41
21
10

CAULKING TUBE WITH AN IMPROVED SEAL TO RETARD THE PASSAGE OF AIR

This application is a continuation of parent application Ser. No. 619,578 filed on Oct. 6, 1975, now abandoned.

BACKGROUND OF THE INVENTION

The present invention relates to an improved caulking tube and more particularly relates to a caulking tube having an improved seal to the passage of air and moisture at the point where the plunger member comes in contact with the rear end of the caulking tube body.

Caulking tubes are well known. There are many designs on the market. Generally, such a caulking tube comprises a tubular body member, a plate attached at one end with an opening therein to which is affixed a protruding sealed nozzle. After the tube is filled, there is inserted at the rear end of the tubular body a plunger member to seal the tube.

To utilize the caulking tube, generally, the tube is inserted into a caulking gun and the sealed tip of the nozzle is cut open in one fashion or another. Then the ram of the caulking gun acts against the plunger forcing the material in the caulking tube out of the now opened nozzle member.

Such caulking tubes usually are utilized to package materials and more specifically sealants in an anhydrous state and to prevent them from coming in contact with the moisture in the air. Most materials that are packaged in caulking tubes upon being exposed to air or the moisture in the air will cure to a hard solid state.

Accordingly, it is highly desirable in the packaging of such materials in caulking tubes that the caulking tubes be as impervious to the passage of air as possible such that the material inside will have a long utility life.

One such sealant material which is packaged in caulking tubes and has to be maintained in an anhydrous state prior to cure is room temperature vulcanizable silicone rubber compositions. Such compositions remain uncured in the anhydrous state but when exposed to the moisture in the atmosphere cure to a solid silicone elastomer. Accordingly, it is highly desirable to package such room temperature vulcanizable silicone rubber compositions in caulking tubes such that such caulking tubes are as airtight as possible without unduly increasing the expense of the tube.

An especially difficult problem in the manufacture and packaging of such materials as room temperature vulcanizable silicone rubber compositions or other sealants in caulking tubes has been to produce an airtight seal with the plunger member. Even though the plunger member is usually a few thousandths of an inch larger than the caulking tube and is forced into the rear end of the caulking tube to make as tight a seal as possible, it has been found that nevertheless an airtight seal in most cases is not produced.

Accordingly, various methods have been tried to solve this problem. For instance, there have been utilized heat sealed aluminum and metal foil caps at the rear end of the caulking tube over the plunger. The difficulty with such metal foil caps is that they unduly increase the expense of the caulking tube and in addition are easily damaged or punctured. End plastic caps have also been tried but these have the same disadvantages as the aluminum foil cap and in addition have been found not to be airtight.

Some manufacturers have utilized adhesives or glues to be applied over the rear end of the caulking tube after the plunger is inserted to produce an airtight seal of the plunger member with the rear end of the caulking tube. The difficulty with this approach is it is a difficult method to apply in manufacturing practices of the filling of caulking tubes with sealant material. Further, difficulties have been encountered by users of the caulking tube as the result of the adherence of the plunger to the interior side of the caulking tube due to the adhesive.

A more advanced approach has been to utilize various non-adhesive coatings applied to the rear end of the plunger and the caulking tube after the plunger has been inserted into the tube. While this approach has been found to be less expensive and creates less difficulties for the user, it has been found that even in these cases airtight seals were not produced in all cases. One reason for this is that in the packaging of some materials in caulking tubes, such materials are poured into the caulking tubes at elevated temperatures and the plunger is inserted. Accordingly, when the material in the caulking tube cools, the plunger is drawn inward and is forced into the tube breaking any seal that may be formed by such exterior coatings as described above. It has been found that a coating with certain materials on the inside of the rear end of the caulking tube produces a superior airtight seal with a plunger without unduly increasing the cost of the caulking tube.

Accordingly, it is one object of the present invention to produce a caulking tube with an improved seal between the plunger member and the rear end of the caulking tube.

It is another object of the present invention to provide an economic caulking tube with an improved seal between the plunger member and the rear end of the caulking tube.

It is still another object of the present invention to provide for an improved caulking tube with a superior seal at the rear end of the tube which allowed the contents of the tube to have a shelf life of 2 years or more.

It is still an additional object of the present invention to provide a simple and economic process for producing an airtight seal between the plunger and the rear end of the caulking tube.

These and other objects of the present invention are accomplished by means of the disclosure set forth hereinbelow.

In the accompanying drawings, FIG. 1 is a side view of an entire caulking tube with a fragmentary view of the front and rear end of said tube.

SUMMARY OF THE INVENTION

Figures 1, 2, 3, 4, 5:
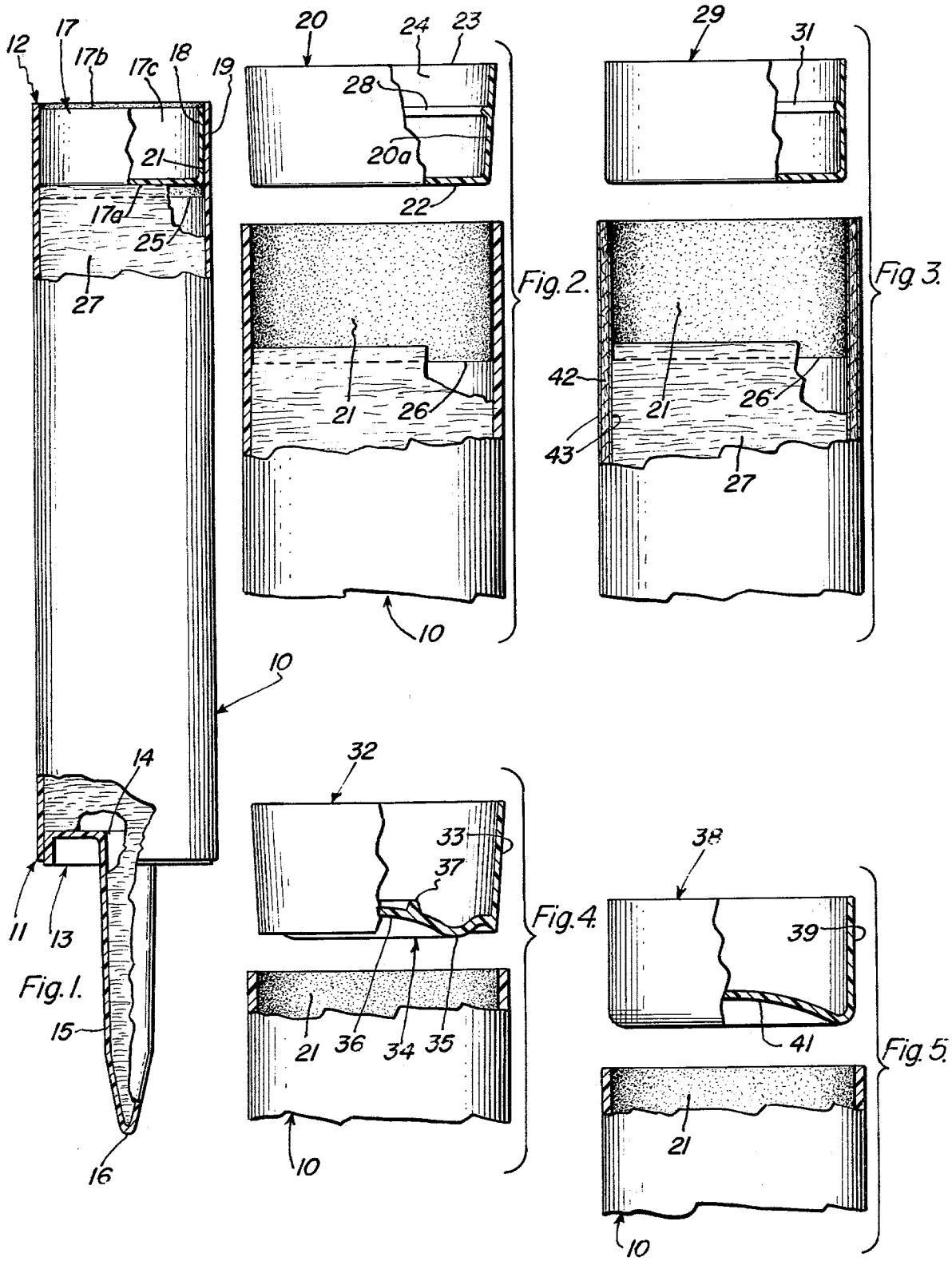
FIG. 2 is cross-sectional view of the rear end of the caulking tube with a fragmentary side view of the plunger in the case where the plunger is tapered.
FIG. 3 is the same view as FIG. 2, except the plunger is not tapered.
FIG. 4 is a view similar to FIGS. 2 and 3, that is, a cross-sectional side view of the rear end of the caulking tube with a different design plunger where the plunger is tapered.
FIG. 5 is similar to FIG. 4, except that the bottom of the plunger is of a different design than that of FIG. 4 and the sides of the plunger are not tapered.

There is provided by the present invention a caulking tube with an improved seal to retard the passage of air and moisture into the tube having a tubular body member with a first end and second end, a cap plate with an opening therein connected to the first end of said tubular member and a protruding tubular nozzle member with a sealed tip on one end and an opening at the other end connected at its opened end to said cap plate over the opening at said cap plate comprising the improvement wherein the internal surface of said tubular member is coated with a moisture proof cohesive, inorganic or organic chemical material which is applied at a thickness of at least 0.001 inches for at least 0.25 inches from said second end around the entire circumference of said second end of said tubular member.

Although a micro crystalline polyethylene based wax is the most preferred material to form the coating, other well known materials may be utilized such as, latexes or greases. It is only necessary that the material can be applied in the thickness indicated at room temperature or at elevated temperatures in a molten state; that it be inert to the material to be packaged in the caulking tube; that it will adhere to the interior sides of the caulking tube whether it be applied in the molten state or otherwise wichout necessarily being adhesive; that it will withstand ambient temperatures without cracking or crazing; that it be moisture proof and that it can be readily applied without special procedures.

There is also provided by the present invention a procedure for forming such a coating which generally comprises applying the coating to the caulking tube by wiping, brushing, spraying or dipping or by any well known application methods for coatings; and that the coating be allowed to dry if necessary. Then the caulking tube is filled with the desired material and the plunger if forced into the rear end of the caulking tube to the point that the front face of said plunger does not go past the inward furthermost point of the coating. This must be true, also, even if the plunger moves forward as a result of the material with which caulking tube is filled cools to room temperature. It has been found that the contact of the plunger with the coating at the rear end of the caulking tube produces a superior seal to the passage of air and moisture there through.

DESCRIPTION OF THE PREFERRED EMBODIMENT

As noted in FIG. 1, there is a side view of a caulking tube which is partially fragmentary at the rear end of the tube and partially fragmentary at the front end of the tube.

The tube comprises a tubular body member as shown by (10) which may be of any desired thickness and is usually 0.050 inches. This tubular body may be completely cylindrical or it may be tapered from the front end (11) to the rear end (12) such that its diameter gets slightly larger as one goes from the rear end to the front end of the tubular body (10). However, this is undesirable since it results in a waste of material by the user of the caulking tube.

To the front end of the tubular body, as is well known, there is provided a cap plate (13) which has an opening in it (14). This cap plate as well as the tubular body member is made of any material that has been treated to that it is airtight and is sealed to the tubular body (10) by well known means.

To cap plate (13) over the opening (14) there is placed and attached to the cap plate a protruding nozzle (15) with a sealed tip (16).

In a new development, the tubular body (10), the cap plate (13) and the protruding nozzle (15) may be all formed in one integral piece from any well known plastic. The integral piece is quite impervious to the passage of air there through. In that case, when it is desired to package material in the tube which has to be maintained in the anhydrous state and the body (10), cap (13) and nozzle (15) are all one piece, it is not necesssry to place a seal over opening (14). The cap plate (13) and the protruding nozzle (15) may also be formed in separate pieces from various materials and sealed together. Tubular body (10) and cap plate (13) may be formed from cardboard which is coated with treated aluminum foil such that the material is airtight. In addition the protruding nozzle (15) which is usually formed from a polyethylene may then be sealed to the cap plate (13) by methods well known in the caulking tube manufacturing industry.

In the case when such tubular body (10), cap plate (13) and protruding nozzle (15) are formed from separate pieces and assembled together and to one unit, it is often necessary to seal opening (14) with an aluminum foil since the low density nozzles have some tendency to allow moisture in the air to permeate there through.

In the case when the tubular body (10), cap plate (13) and protruding nozzle (15) are formed in one integral piece from a plastic such as, high density polyethylene, polypropylene, or an ethylene/propylene copolymer then it is not necessary to put a metal foil over opening (14) since the plastic, if utilized of sufficient dimensions, is impervious to the passage of moisture in the air through the nozzle (15) or any part of the tubular body (10). The parts in the assembly of the caulking tube which are impervious to the passage of air are well known and form no part of the present invention.

The caulking tube composed of tubular body (10), cap plate (13) and protruding nozzle (15), thus, assembled and made in whatever way or manner are normally impervious to the passage of air for extended periods of time. However, caulking tubes in this fashion are then taken and put on an apparatus in which they are filled with materials such as, sealants. After they are filled with the sealant and specifically with room temperature vulcanizable silicone rubber compositions at a temperature of 50° to 100° F., there is forced into the rear end of tubular body (10), a plunger member (17) having a front face (17*a*) and a rear face (17*b*). As the room temperature vulcanizable silicone rubber composition cools to room temperature it has the tendency to draw the plunger (17) further into tubular body (10) such that there are formed air passages between side (18) of plunger (17), and side (19) of tubular body (10), allowing air leaks into the sealant that was packaged in the caulking tube. This was noticed even in the case of materials that were at ambient temperatures when they were packaged and even though the diameter of width of the plunger member was greater than the integral diameter or width of tubular body (10), the material packaged did not have an tendency to cool and cause a further forcing of the plunger into the rear section of tubular body (10). Nevertheless, air leaks or openings were formed between side (18) and side (19) of tubular body (10) which resulted in a premature curing of the room temperature vulcanizable silicone rubber composition packaged in such caulking tubes.

Accordingly, it was the invention of the present case to coat the internal and rear end of tubular body (10) and specifically side (19) with a thin coating (21) of a moisture proof material. This coating must be at least 0.001 inches thick to provide sufficient sealing capabilities. Generally, the coating thickness may vary from 0.001 to 0.015 inches and preferably from 0.001 to 0.010. If the coating is less than 1000ths of an inch, sufficient seal will not be formed. If it is more than 15,000ths of an inch there will be difficulties encountered in forcing the plunger into the rear end of tubular body (10).

It must be appreciated with respect to the upper limit of the thickness of the coating that this will depend on the internal diameter of plunger member (17) as compared to the internal diameter or width of side (19) of tubular body (10). Generally, as can be more clearly seen in FIG. 2 in the case of plunger (20), the sides of the plunger (20) will be tapered from its front face (22) and its front face will be smaller than at its rear face (23). With respect to such tapered plungers such as the one shown in FIG. 2, it is only necessary that at some point of side (20*a*) prior to reaching rear face (23), side (20*a*) have a diameter or length that is at least 0.010 inches larger than the internal diameter of side (19), the rear end of tubular body (10), if a proper seal is to be formed. Preferably, the diameter portion of side (20*a*) of plunger member (20) prior to reaching rear face (23) is 0.01 to 0.08 inches larger than rear diameter of side (19) of tubular body (10) at the point which plunger (17) or (20) is inserted and at the point in tubular body (10) where the plungers come to rest.

Accordingly, with the above description, it can be appreciated that the thickness of coating (21) will depend on the external diameter of side (18) of plunger member (17) as well as of tapered plunger (20). The dimensions given above hold true and in any case a coating of a thickness of at least 1000ths of an inch is needed. It should be noted that side (18) of plunger (17) is straight while the side of plunger side (20*a*) of plunger (20) is tapered.

It should also be noted that both plungers (17) and (20) have a cavitation (17*c*) and (24), respectively, in the plunger between the front face and the rear face of said plungers. These cavitations (17*c*) and (24) are necessary and not only results in a saving of material in producing the plunger but it is also desirable as an area into which face of the forcing rod of a caulking gun can be inserted into the operate the caulking tube so that it may dispense the material packaged therein.

With respect to the width of the coating (21) this will depend on how far the plunger (17) moves into the rear end of tubular body (10) before it comes to rest. In one case, the sealant material is packaged at room temperature and in a second case the material may be packaged in tubular body (10) at elevated temperatures which may result in forcing the plungers (17) and (20) further into tubular body (10) after the material has cooled. It is only necessary in both cases that coating (21) be applied around the interior circumference of side (19) such that when the front face of (17*a*) of plunger (17) or (22) of plunger (20) will not be inward beyond the furthermost point (25) in FIG. 1 and (26) in FIG. 2 of coating (21) when it finally comes to rest. The plunger (17) has straight sides but with the case of tapered plunger (20), it is only necessary that the side (20*a*) of plunger (20) that are in contact with the interior side (19) of tubular body (42*a*) do not extend into the tubular body (10) beyond the foremost point of coating (26) in FIG. 2. As pointed out previously, plunger (17) and (20) both have a cavitation in them. It can be appreciated that the plunger member may be made of a thin plate without any cavitation. Accordingly, in those cases the coating (21) need extend only a slight distance into the interior of the rear end of side (19) inward toward the front end (11) of the caulking tube and specifically the coating need only extend for at least 1.25 inches uniformly around the rear end of the interior of side (19) of tubular body (10). Preferably, such coating (21) extends from 1 to 3 inches uniformly around the interior side (19) of tubular body (10). As can be appreciated, such coating can extend for any distance within the tubular body (10), in fact the entire internal side of tubular body (10) may be coated with coating (21). However, this has not been found necessary to produce a good seal with plunger member (17) and results in an unnecessary waste of material.

FIG. 1 shows plunger member (17) after it has been inserted in the caulking tube which has been filled with sealant material (27), which in a room temperature vulcanizable silicone rubber composition, which when placed in tubular body (10) at a temperature of 75° F. has cooled forcing plunger (17) to move further into tubular body (10) such that there is a distance of about a 16th of an inch between rear face (17*b*) and the rear end of (12) of tubular body (10). It should be noted that in any case the foremost point (25) of coating (21) extends some distance such as, $\frac{1}{8}$th to $\frac{1}{2}$ inch beyond the front face (17*a*) of plunger member (17) when the plunger member (17) finally comes to rest.

Any inert stable moisture proof coating material may be utilized to produce coatings (21). The invention of the instant case does not particularly lie in a particular type of material to be utilized in a coating although there are such preferred materials. In its most basic sense, the invention of the instant case lies in the coating of the internal side of tubular body (10) in the manner described hereinabove. As stated previously, the coating may be a chemical compound or composition which is moisture proof, does not craze or crack at room temperature, and will adhere to the inner surface of tubular body member (10), although it should not be an adhesive. In addition, the coating must be inert to the material that is packaged in tubular body member (10) and more specifically to room temperature vulcanizable silicone rubber compositions. Further, for economy purposes, it must be capable of being applied readily without any special application techniques. Materials that are difficult to apply but have the above properties will unvariably increase the cost of producing the caulking tube.

Preferred compounds for forming such coatings, that is, coating (21), are waxes and more specifically are micro crystalline polyethylene based wax such as, Derex 10, Derex 12, Derex 22 and Derex 44 (Derex being the tradename of the Dewey and Almy Co, subsidiary of W. R. Grace Co., located in Massachusetts). Other preferred materials that can be utilized to form the coating are greases, latexes, silicone greases and even certain room temperature vulcanizable silicone compositions or silane compositions. If the material with which a caulking tube is to be filled is desirably a room temperature vulcanizable silicone rubber composition which in some cases are formed into the tubes at temperatures of between 120° to 160° F., it is also necessary that the coating have a melting point of above 160° F. Such a condition is met by the Derex micro crystalline waxes identified herein above.

With respect to the plunger member (20) of FIG. 2, it is noted that such a plunger member has a reinforcing rib (28). Such reinforcing ribs are not necessary but in some cases are fabricated into the plunger member so as to give it extra strength to withstand the forces of the forcing rod of the caulking gun which acts upon the plunger.

FIG. 3 is a view similar to FIG. 2, the only difference being in that plunger member (29) has straight edges and unlike plunger member (17) has a reinforcing rib (31).

FIGS. 4 and 5 are simply cross-sectional views of the rear end (12) of tubular body member (10) with fragmental cross-sectional views of different types of plungers. Accordingly, in FIG. 4 there is a highly popular plunger member (32) which has tapered sides (33) for insertion into tubular body member (10) in which the front face (34) of plunger member (32) has a protruding curvature (35) adjacent to sides (33) and an indentation (36) along the central part of it over which is a reinforcing rib (37). This particular form of front face (34) of plunger (32) results in a plunger whose front face (34) is extremely strong as well as being easily gripped by the forcing rod of the caulking gun. In addition, such a design of the plunger member allows the caulking gun with a minimum of pressure to evenly and uniformly force the plunger through the interior of tubular body (10) when the material that is packaged inside tubular body (10) is being applied.

Plunger member (38) of FIG. 5 is of the type of FIG. 4 except it has straight sides (39) and a more simple type of indentation on its front face (41) for the same purposes as was explained with respect to plunger (32). These various different types of plungers such as the most preferred one of FIG. 4, have been shown in the present case to illustrate that the present coating on tubular body (21) may be utilized with any plunger, irrespective of its design.

With respect to tubular body (10), two different types of design are indicated, FIGS. 2 and 3. In FIG. 2, tubular body (10) is of an all plastic integral composition as in FIG. 1. In FIG. 3, tubular body (42) is formed from cardboard which is lined on both sides with treated moisture proof aluminum foil (43) to which coating (21) is applied thereover.

The above illustrates the two most reliable moisture proof constructions of tubular body member (10) that is utilized to produce caulking tubes. However, the present invention applies to tubular body member made of any material. The improved sealing method of the present case for producing an impervious seal between the plunger and the rear end of the caulking tube in accordance with the above disclosure is carried out by a simple but efficient process. The tubular body member with the front plate (13) and protruding nozzle as first formed by the manufacturer are taken and there is applied the coating within the dimensions specified above by any simple and efficient means such as, by dipping, spraying, brushing or wiping. In the case of the Derex microcrystalline waxes, the wax is first melted and then the wax is taken and applied to the interior of tubular body member (10) by any method in the dimensions and depth specified above into the tube and as far along the tubular body as is desired to have the wax coating. The wax is allowed to cool to room temperature wherein the desired coating (21) has been formed in the interior surface of tubular body member (10). The tubes may then be taken and placed on an apparatus or filled by hand with the material that is desired to be packaged. In the case of room temperature vulcanizable silicone rubber compositions, such material is by machine automatically measured into the tubes and the plunger (17) is forced thereover. As the room temperature vulcanizable silicone rubber composition cools, the plunger will be forced further down into the tubular body member (10). As specified earlier, it is only necessary that the front face (17*a*) of plunger member (17) does not extend beyond the foremost point of (25) of coating (21) after the composition in the tubular body member (10) has cooled. This distance is well known by experience and the width of the coating that is accordingly applied.

Accordingly, there is formed in this manner, an airtight seal between the plunger and the rear end of the caulking tube. Such a sealing method such as that disclosed in the instant case and such a sealed caulking tube has a shelf life of 25 to 50% longer than prior sealed caulking tubes which were packaged with room temperature vulcanizable silicone rubber compositions. It has a shelf life of about 2 years with a minimum amount of failures.

To utilize such a sealed caulking tube as is well known, the caulking tube is placed in a caulking gun, the tip (16) of nozzle (15) is cut off with any sharp instrument. If there is a foil in opening (14) this is opened by simply inserting a nail down tip (16), the nail is removed and the caulking gun is operated to apply the material in the caulking tube.

One outstanding advantage of the present sealed caulking tube of the present invention is that it allows an airtight seal to be formed between the plunger and the interior sides of the rear end of the caulking tube while at the same time permitting the plunger to be moved with facility by the caulking gun in dispensing the room temperature vulcanizable silicone rubber composition sealant.

I claim:

1. A caulking tube with an improved seal to retard the passage of air into the tube having a tubular body member with a first end and a second end, a cap plate with an opening therein connected to a first end of said tubular member, and a protruding tubular nozzle member with a sealed tip at one end and an opening at the other end connected at its open end to said cap plate over the opening at said cap plate comprising the improvement wherein the internal surface of said tubular member is coated with a moisture proof cohesive, inorganic or organic chemical material which is selected from the class consisting of polyethylene based microcrystalline waxes, and latexes, which is applied at a thickness of at least 0.001 inches for at least 0.25 inches from said second end around the entire circumference of said second end of said tubular member and wherein a round integral plunger member constructed from plastic with a front face and a rear face is inserted into said tubular member at its second end to form an airtight seal provided that the front face does not extend beyond said coating.

2. The caulking tube of claim 1 wherein the thickness of said coating varies from 0.003 to 0.010 inches.

3. The caulking tube of claim 1 wherein said coating is applied at a width of 1.0 to 3.0 inches from said second end around the entire circumference of said second end of said tubular member.

4. The caulking tube of claim 1 wherein said microcrystalline wax is adhesive in the molten state and is inert to room temperature vulcanizable silicone rubber compositions and will not melt up at temperatures of up to 160° F.

5. The caulking tube of claim 1 wherein said tubular member is substantially filled with a room temperature vulcanizable silicone rubber composition.

6. The caulking tube of claim 1 wherein some portion of said plunger member along its axis from up to but not including the rear face has a width that is at least 0.010 inches larger than the width of said second opening in said tubular member.

7. The caulking tube of claim 6 wherein the width of said portion of said plunger member is from 0.010 to 0.080 inches larger than the width of said second end of said tubular member.

* * * * *